United States Patent [19]

Markarian et al.

[11] Patent Number: 4,538,669

[45] Date of Patent: Sep. 3, 1985

[54] DISTORTION MEASUREMENT IN CASTING

[75] Inventors: Kegham M. Markarian, Woodmere; Robert Sobolewski, Streetsboro, both of Ohio

[73] Assignee: Republic Steel Corporation, Cleveland, Ohio

[21] Appl. No.: 565,841

[22] Filed: Dec. 29, 1983

Related U.S. Application Data

[63] Continuation of Ser. No. 297,958, Aug. 31, 1981, abandoned.

[51] Int. Cl.[3] ..... B22D 11/16

[52] U.S. Cl. ..... 164/451; 164/150; 33/143 R; 33/143 L; 33/147 L

[58] Field of Search ..... 164/150, 154, 414, 451, 164/452, 455; 33/148 R, 174 R, 148 H, 143 R, 143 L, 147 R, 147 E, 147 L, 147 N

[56] References Cited

U.S. PATENT DOCUMENTS

| | | | |
|---|---|---|---|
| 1,175,401 | 3/1916 | Barnes | 33/148 R X |
| 3,100,889 | 8/1963 | Cannon | 33/143 L X |
| 3,562,918 | 2/1971 | Ertman et al. | 33/174 L |
| 3,633,010 | 1/1972 | Svetlichny | 164/4.1 |
| 3,892,043 | 7/1975 | Bonikowski | 33/147 L X |
| 4,030,531 | 6/1977 | Wunnenberg et al. | 164/454 |
| 4,170,067 | 10/1979 | Yohe et al. | 33/143 L |
| 4,294,305 | 10/1981 | Oda | 164/150 |

FOREIGN PATENT DOCUMENTS

| | | | |
|---|---|---|---|
| 2444443 | 3/1975 | Fed. Rep. of Germany | 164/154 |
| 422527 | 9/1974 | U.S.S.R. | 164/150 |

*Primary Examiner*—Kuang Y. Lin

*Attorney, Agent, or Firm*—Watts, Hoffmann, Fisher & Heinke Co.

[57] ABSTRACT

Apparatus and method is disclosed for on-line monitoring for early detection of diagonal distortion in a moving cast product ideally having a rectangular cross-section. A pair of contact rollers is supported on respective guide arms at a location along the casting path and biased to resiliently impinge on opposite edges of the moving cast product. A detector continuously senses the amount of separation between the contact elements to detect diagonal distortion in casting cross-section. A recorder is used to provide a tangible record of such variation. Optionally, both diagonals can be measured, and their sum or difference continuously monitored as well. A fixed support member carries the arms on slidable linear motion bearing structure to facilitate translational motion of the contact elements relative to the casting path, to minimize the effect of casting motion waver on contact separation.

13 Claims, 6 Drawing Figures

DISTORTION MEASUREMENT IN CASTING

This application is a continuation of application Ser. No. 297,958, filed Aug. 31, 1981, now abandoned.

TECHNICAL FIELD

The invention relates to bloom casting. In the casting operation, a batch of molten metal is passed from a ladle to a vertical mold whose cross-section describes the peripheral shape of the product to be cast. To start the process, a "dummy bar" or slidable plug is inserted in the mold just before the metal pouring begins. The dummy bar supports the first poured metal until it begins to harden to form a base for the subsequently poured metal. After the dummy bar passes through the mold, it is removed from the system.

As molten metal fills and passes downwardly through the mold, a cooling system sprays water against the mold and against the product as it emerges from the mold. During its transit through the cooling mold, the molten metal partially hardens into a shape defined by the mold cross-section. Lower down, powered rollers engage and propel the cast product, or strand, out of the mold toward a cutting station where the cast product is divided into appropriate lengths.

While many shapes can be cast in such an operation, a shape frequently cast is that of a rectangular cross-sectional billet.

BACKGROUND ART

Whatever the cast shape, several problems arise in continuous casting due to the incomplete solidity of the cast product during its manufacture. Such problems include warping of the product and diagonal distortion of its cross-sectional shape. Aside from the obvious disadvantages of warping and distortion relating to misshaping, such conditions can cause internal cracking of the cast product. Such cracking, often called "Z cracks" too often results in rejection of the product, at least for its primary use, for failure to meet quality control standards, due to lack of internal product integrity.

Accordingly, some have proposed techniques for monitoring characteristics of a continuously cast product. In one such proposal, a wheel resiliently impinges upon a flat surface of a cast product as it leaves the casting mold. A lever structure responds to fluctuations in the position of the wheel to adjust water spray apparatus to minimize warp in the cast billet. Such a technique, however, senses only warp or waver in the single surface along which the wheel rolls, and cannot with certainty sense directly changes in cross-section of the billet. The system is likely to spuriously interpret waver of the billet as it emerges from the mold as a defect in the product when in fact no product defect exists.

Other proposals have involved the use of a sensing lever on one side of a billet to detect its position or deflection during processing. Such systems, likewise, do not affirmatively sense changes in cross-sectional dimensions of the strand.

Another proposal involves the use of a mechanical, electrical or optical ingot thickness sensor for a steel billet coming off a casting line. In response to sensed thickness, various characteristics of the casting process can be altered, in order to maintain the desired thickness. Again, no direct indication of diagonal deformation results.

In other applications, it has been suggested to use substantially immovable force sensors impinging on surfaces of cast steel product to measure its characteristics. Still other proposals, directed more specifically toward rectangular billets, involve substantially immovable rollers for engaging the edges of the strand to squeeze it during production to maintain a desired cross-sectional configuration. This means, however, sometimes causes cracking or other imperfections in the product, rather than minimizing or eliminating them.

In addition to the on-line techniques described above, diagonal dimension of rectangular cross-sectioned billets has been manually measured by means such as calipers after production and cutting. While this technique detects product distortion imperfection, it does not furnish such information sufficiently early to enable remedial measures in the production operation which would otherwise minimize or eliminate product defects.

It is thus a general object of this invention to produce on-line an unambiguous real time direct measurement indication of cross-sectional diagonal distortion of a cast product strand without influencing product characteristics by the automatic measurement operation itself.

DISCLOSURE OF THE INVENTION

The disadvantages and shortcomings of the prior systems as described above are eliminated or reduced by the present invention, which accomplishes the object stated in the previous paragraph.

In accordance with one embodiment of the invention, a system is provided for monitoring cross-sectional variation in a cast strand movable along a path and having ideally a cross-section in the shape of a polygon. The system includes at least two contact elements, along with structure for supporting the contact elements and biasing those elements to impinge on different respective edges of the cast strand. A detector is provided for sensing the relative positions of the contact elements.

The technique of providing for the contact element to impinge upon the edges of the cast product, rather than merely upon a flat surface, provides a direct indication of cross-sectional diagonal distortion. As set forth above, the simple imposition of a contact element on a flat surface of the casting does not necessarily indicate the degree of diagonal distortion, as mere changes in the thickness of the cast ingot, or variations in path of travel, unaccompanied by diagonal distortion, can cause a variation in such a surface measurement.

Moreover, the use of a pair of diagonally opposed contact elements provides an affirmative measurement of diagonal distortion and will not be likely to spuriously represent as diagonal distortion waver or deflection of the cast strand as it proceeds through the caster.

In accordance with a specific embodiment of the invention, the contact elements preferably comprise rollers suitable for engaging and rolling along the edges of the cast strand. Alternately, the contact elements can suitably be made of a relatively flat or angled configuration for sliding along the edge. Such sliding action assists in removing scale which may have accumulated on the cast strand and which could give rise to vibrations or jitter of the contact elements which might mistakenly signal diagonal distortion where none exists.

In accordance with a more specific aspect of the invention, tests have shown that contact elements can suitably be made of steel or of ceramic material. These materials are appropriately heat and abrasion resistant and strong enough for application in practicing this invention.

In accordance with another feature of the invention, the support structure for holding the contact elements includes a support member which is fixed relative to movement of the strand through the casting machine. A pair of guide arms are pivotally mounted on the support member and extend to generally opposite sides of the strand. Each arm bears one of the contact elements on its inner side for engaging a different respective edge of the strand. Spring biasing structure is coupled between the support member and each guide arm for biasing the contact members toward each strand.

In accordance with another feature, pneumatic, electric or other type of power structure is also coupled to the guide arms in order to provide, on command, forced separation of the arms to release the contact members from the edges of the strand. This feature facilitates insertion and passage of the dummy bar through the mold.

Still another aspect of the invention includes the addition of slidable bearing or bushing structure between the guide arms and the support members. This type of slidable mounting provides a facility for the guide arms to slide back and forth transverse to the strand path in the event that the casting wavers as it emerges from the casting mold. This feature renders the monitored separation of the contact elements less dependent on casting waver, and conversely more definitely indicative of cross-sectional dimension of the strand.

The dectector of contact element separation, in accordance with another specific feature, preferably comprises a linear potentiometer. It can also comprise a linear voltage differential transformer. Other techniques, such as optical, could also be suitable. Such detector apparatus gives a continuous and accurate reading of contact element separation necessary for monitoring diagonal distortion of the casting.

In accordance with still another specific feature, a recorder, such as a strip chart recorder, can be coupled to the detector in order to produce a permanent and tangible record of the detector output over a period of time. Such a feature enables after-the-fact review of the history of a production run.

In accordance with another specific feature, the invention comprises feedback control servo apparatus responsive to the output of the detector for remedially modifying a parameter of the casting operation, such as the rate of water flow in the casting mold, in accordance with known techniques for correcting sensed diagonal distortion, before that distortion becomes critical to product quality.

In accordance with another specific feature of the invention, two pairs of contact elements each measure a different diagonal dimension of a rectangular billet. Additional quality control can be maintained by producing a continuous indication of the sum or difference of the diagonals so measured.

By providing for the above described measurements to be taken on the casting line itself rather than subsequent to the making of the product, one can in real time respond to the indications of diagonal distortion and apply necessary remedial measures.

The present invention will be understood in more detail by reference to the following specific description, and to the drawings, in which:

BEST MODE FOR CARRYING OUT THE INVENTION

Figure 1:
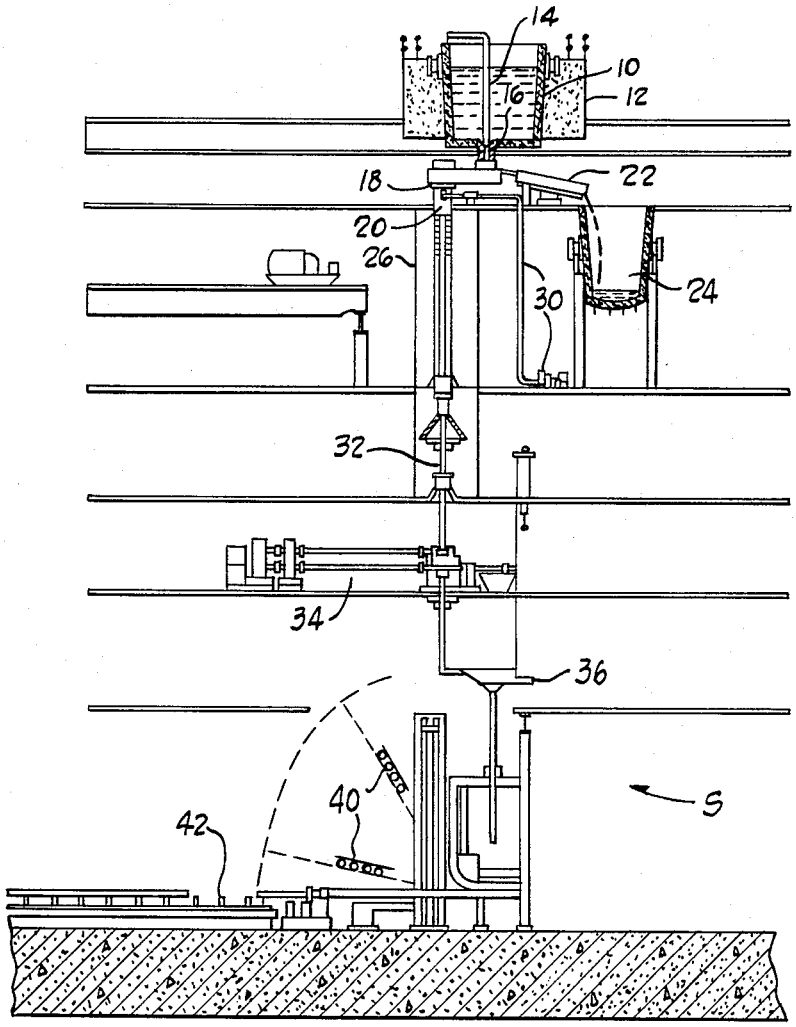
FIG. 1 is an elevational and partially schematic view of a continuous casting system suitable for incorporation of the present invention.

FIG. 1 illustrates a casting system S in which the present invention is suitable for incorporation. The system of FIG. 1 receives batches of molten metal to be cast and produces a relatively large dimensioned strand of cast material which can be cut into billets of appropriate length for fabrication into other products.

Referring to FIG. 1, molten metal for casting, such as steel, is placed in a ladle 10 having a capacity of approximately 200 tons of molten metal. The ladle is transported in a ladle car 12 which carries the car horizontally as desired for appropriate registration with the casting system.

A stopper rod 14 is mounted in the ladle 10 and can be inserted into or withdrawn from an orifice 16 defined in the bottom of the ladle. Insertion and removal of the stopper rod controls gravity metal flow from the ladle into a tundish 18. The tundish 18 guides the molten metal into an elongated vertical mold 20, behind an initially inserted dummy bar, in which the molten metal, while descending, cools and gradually sets up into a partially solid casting strand. The strand has a cross-sectional shape defined by and corresponding to the inside cross-sectional shape of the mold.

Excess molten metal spilling from the tundish and the mold is transmitted by a tundish overflow trough 22 into an emergency ladle 24.

Below the mold 20 is located a spray chamber 26. Within the spray chamber, known water spray apparatus (not shown) directs a flow of water against the outside surface of the cast strand after it emerges from the mold.

A drive structure 30 continuously oscillates the mold. This action encourages the semi-molten metal in the mold to migrate downwardly through the mold as it cools.

The casting strand, indicated by the reference character 32, ultimately emerges from the mold, by the action of a powered withdrawal roller system 34. A cutoff torch 36 cuts the emerging strand into suitable length billets for further processing and/or delivery to purchasers.

The billets, indicated by the reference character 40, are laid down onto a runout table 42, which transports them to a downstream work station.

The elements of the casting system illustrated generally in FIG. 1 are known in the art, as is illustrated in part by expired U.S. Pat. No. 2,726,430, which is hereby expressly incorporated by reference.

One of the problems frequently encountered in this type of casting is distortion of the cross-sectional profile of the casting strand. Such distortion results from the fact that the cast strand, during its transit through the mold and for a time thereafter, is not in a completely solidified condition. Rather, the strand has a tendency towards cross-sectional deformation during its movement. While this deformation can occur with any cast shape, strands which are rectangular in cross-section are particularly susceptible.

Figure 2:
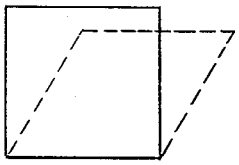
FIG. 2 is an illustration of a cross-section of a casting strand such as produced by the system of FIG. 1, illustrating diagonal distortion.

FIG. 2 illustrates in solid lines a specific example of a desired rectangular cross-section for a strand. Dotted lines in FIG. 2 illustrate the condition (exaggerated for clarity) in which the casting strand has undergone diagonal distortion, wherein the rectangular cross-section has been deformed into a rhomboid. This condition is sometimes called "rhomboidity". As can easily be seen, diagonal distortion affects considerably the diagonal dimensions of the polygonal cross-section.

A major feature of the present invention is the provision of continuous, on-line detection of diagonal distortion in a strand. When detection of the deformation occurs sufficiently early in the casting process, remedial measures can be taken in order to restore the cast metal product being made to its desired rectangular cross-section before the diagonal deformation becomes severe enough to warrant rejection of the product on quality control standards.

Figure 3:
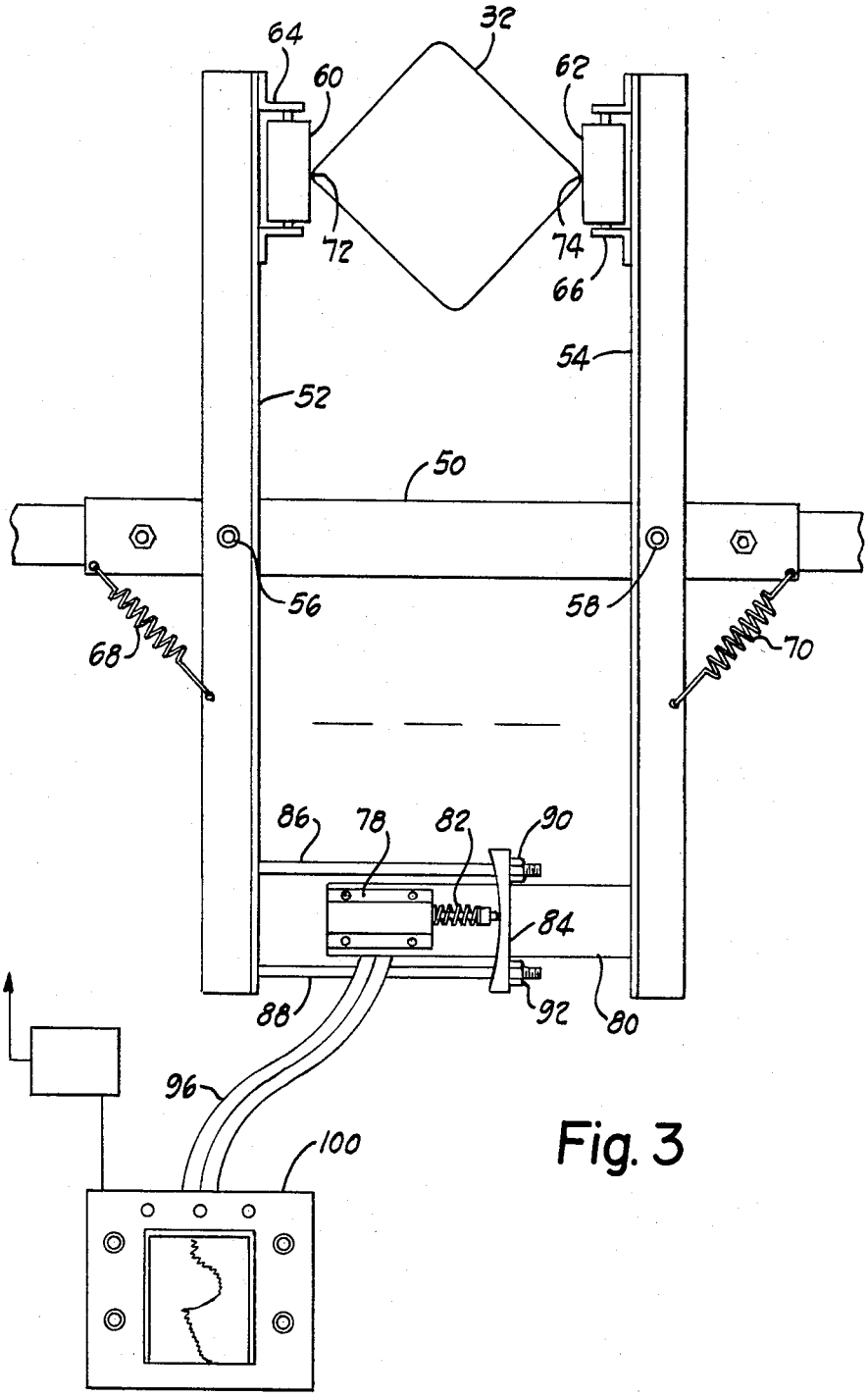
FIG. 3 is a top view of one embodiment of a distortion monitoring system which can be incorporated in the system of FIG. 1.

FIG. 3 illustrates a system for detecting diagonal deformation in a rectangular cast shape. FIG. 3 is a top view of a system for detecting diagonal deformation, looking vertically down at a cross-section of the casting strand 32. In FIG. 3, the cast strand 32 is considered to be moving downwardly into the plane of the paper.

The detection system includes a support member 50 which is fixed relative to the main framework of the casting system. The support member 50 carries a pair of guide arms 52, 54 pivotally mounted on the support member by pivot structure 56, 58. Thus the guide arms 52, 54 are facilitated for pivoting about the structure 56, 58 in the plane of the paper of FIG. 3.

The guide arms extend to opposite sides of the cast strand 32. Each guide arm carries a contact member 60, 62, respectively. Each of the contact members 60, 62 comprises a steel roller appropriately journaled to its respective guide arm by known bearing structure 64, 66.

Tension springs 68, 70 are coupled between the guide arms and the support member as shown in FIG. 3 for resiliently biasing the contact members 60, 62 each against a respective opposite edge 72, 74 of the strand.

The detection system operates in response to variations in the degree of separation between the contact element 60, 62. This degree of separation is detected in this embodiment by an electrical sensing detector which suitably can comprise a known type of linear potentiometer indicated generally at 78, such as is sold by Computer Instruments Corporation of Hempsted, N.Y., U.S.A. The detector 78 is mounted on a strut 80 which is fixedly coupled to the guide arm 54. Thus, as the guide arm 54 pivots about the pivot 58, so also does the potentiometer move in an arc of large radius.

The detector 78 senses the degree of separation between the contact elements by way of a spring loaded sensor shaft 82 which abuts resiliently the concave side of a curved contact plate 84. The contact plate 84 is attached to guide arm 52 by means of a pair of rods 86, 88. The relative position of the contact plate 84 and the sensor shaft is adjustable by adjusting the threaded bolts 90, 92.

The detector when embodied by a linear potentiometer and appropriately supplied with electrical power in known fashion over a multi-stranded electrical cable 96, produces a voltage output which is a substantially linear function of the degree of compression of the spring loaded sensor shaft 82, which is, in turn, a function of the amount of separation between the guide arms 52, 54. In this way, the voltage signal produced by the detector is substantially a linear function of the separation between the contact elements 60, 62.

A recording apparatus, such as a strip chart recorder 100, suitably comprising an Electronik 193 sold by Honeywell of Fort Washington, Pa., U.S.A., can be positioned to receive and respond to the output of the linear potentiometer to produce a tangible and permanent time record of the separation between the contact elements 60, 62. This indication, as it can be seen from the foregoing description, is indicative of the degree of diagonal distortion of the cast strand.

Corrective measures can be taken in response to an indication of undesirable shape change. An example of such remedial measures can include mold replacement and redistribution of the water coolant flow. The water flow redistribution can be either between casts or during a cast, to "steer" a distorted casting back into proper shape or an on-line basis.

The contact element 60, 62 can optionally assume different forms and comprise different materials. While tests have shown that certain types of heat and abrasion resistant steel are appropriate for constituting the contact elements, it has been shown that ceramic materials are suitable as well, such as a tile known as Weld-Al, made by The Carborundum Company, Keasby, N.J., U.S.A. While FIG. 3 illustrates the contact element 60, 62 as pivotable rollers, other tests have shown that relatively flat plates are also suitable for contact elements. An advantage of the use of flat slidable plates is that such plates help to remove scale which accumulates on the outside of the strand and whose roughness can sometimes cause fluctuations in contact element separation which may spuriously be interpreted as changes in the cross-sectional dimension of the strand.

The separation detector 78 can optionally comprise a linear voltage differential transformer, instead of a linear potentiometer. Persons of ordinary skill in the art may also be able to provide other displacement detection apparatus such as optical equipment for performing the measuring function.

Optionally, pneumatic or electrical power structure 99 (see FIG. 4) can be coupled to the guide arms, to separate, on command, the contact elements when desired.

Figure 4:
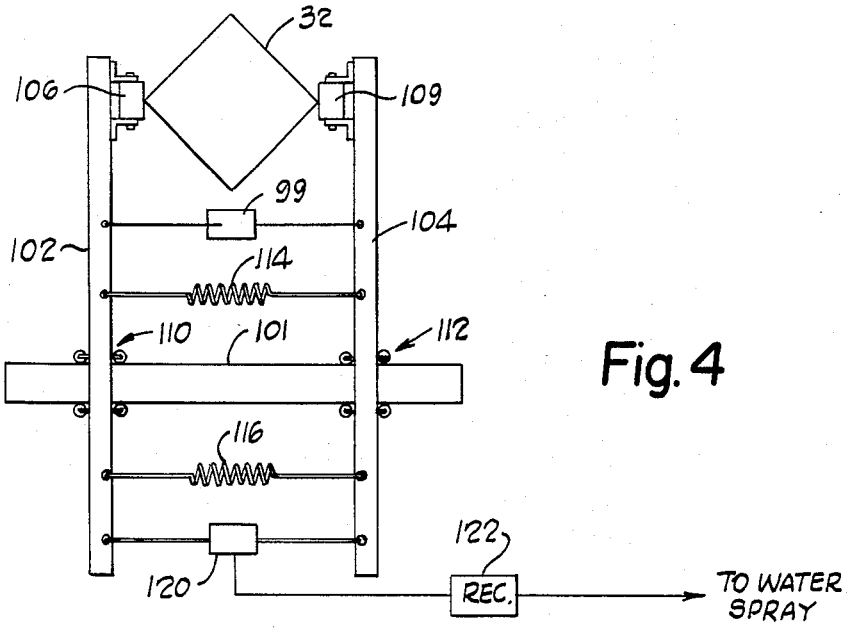
FIG. 4 is a simplified graphical top view of another embodiment of a monitoring system suitable for incorporation in the casting system of FIG. 1.
Figure 6:
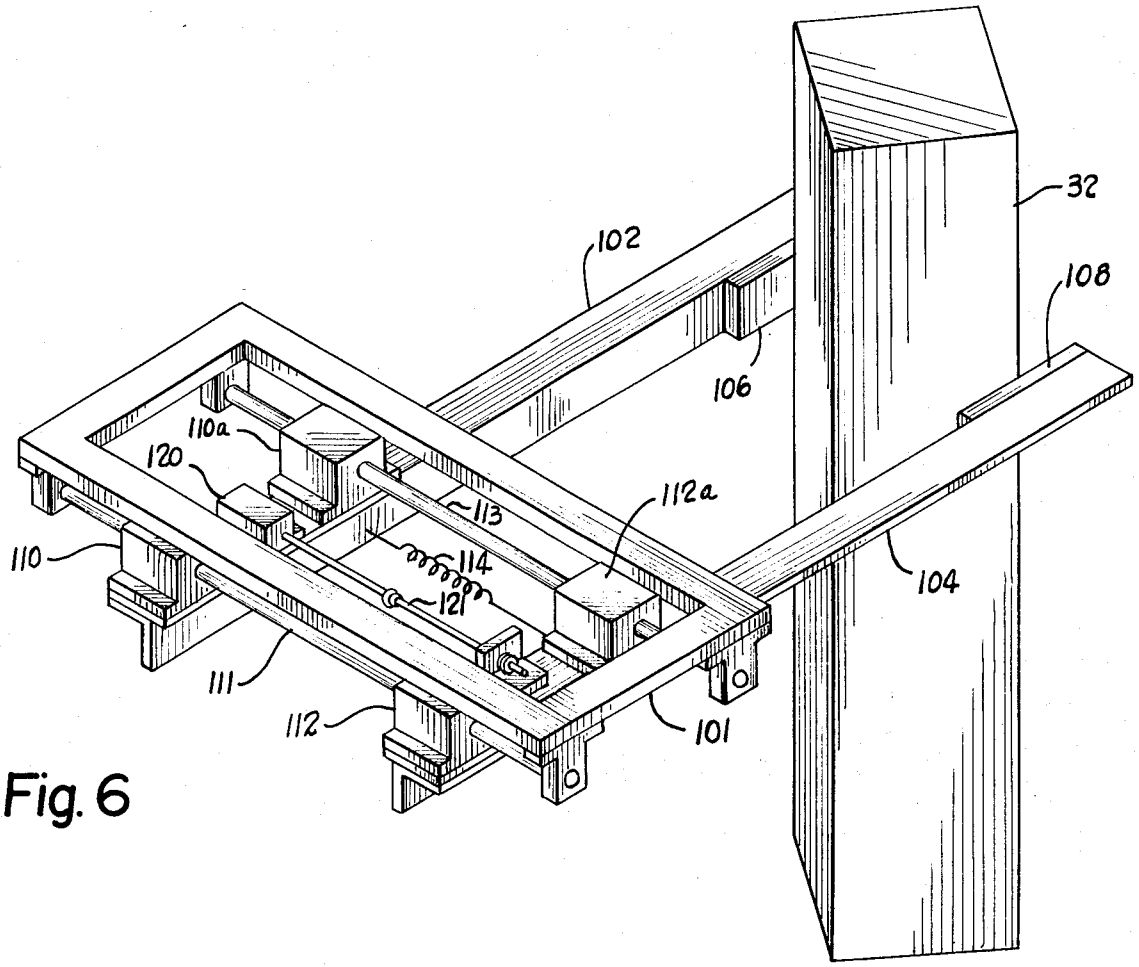
FIG. 6 is a pictorial view showing in more detail the embodiment shown in FIG. 4.

FIGS. 4 and 6 illustrate another embodiment of the present invention. This embodiment is designed to minimize the effect of waver of the casting strand movement upon diagonal measurement. FIG. 4 shows the embodiment in a simplified graphical form, while FIG. 6 shows it in a more detailed pictorial fashion.

The FIGS. 4 and 6 embodiment minimizes the effect of waver by providing facility for the guide arms to move transversely with respect to the general path of the strand being cast. In the embodiment of FIG. 3 utilizing pivoting guide arms, waver or deflection in the path of the casting strand could conceivably affect the separation of the contact elements notwithstanding the absence of variation in the cross-sectional diagonal dimension being measured.

More specifically, the embodiment of FIGS. 4 and 6 provides a support member 101 similar to that of FIG. 3, on which are mounted guide arms 102, 104 (via block-supported shafts 111, 113 in FIG. 6) in turn carrying contact elements 106, 108. In FIG. 6, the contact elements are shown as slidable shoes. As in the previous embodiment, the contact elements impinge upon the edges of the strand.

Linear motion bearing structure 110, 112 (110, 112, 110*a* and 112*a* in the more detailed FIG. 6) is associated respectively with each of the arms 102, 104 in order to provide facility for slidable movement of the arms transversely right and left in FIG. 4 with respect to the support member 101. Additionally, the bearing structure maintains the guide arms substantially perpendicular to the support member 101. Suitable linear motion bearings comprise Ball Bushings For Linear Motion sold by Thompson Industries, Inc. of Manhasset, N.Y.

Tension springs 114, 116 (114 only in FIG. 6) resiliently bias the guide arms and contact elements together so that the contact elements 106, 108 each resiliently engage an edge of the strand.

A detector 120, similar in nature to that described in connection with FIG. 3, is coupled by a spring loaded sensor shaft 121 (FIG. 6) between the guide arms at a location remote from the contact elements. An output from the detector 120 is directed to a recorder 122 for recording in a manner similar to that associated with the FIG. 3 embodiment.

Indication circuitry, of known type, may be used to respond to the detector to provide an indication whenever cross-sectional deviation exceeds a predetermined standard.

Figure 5:
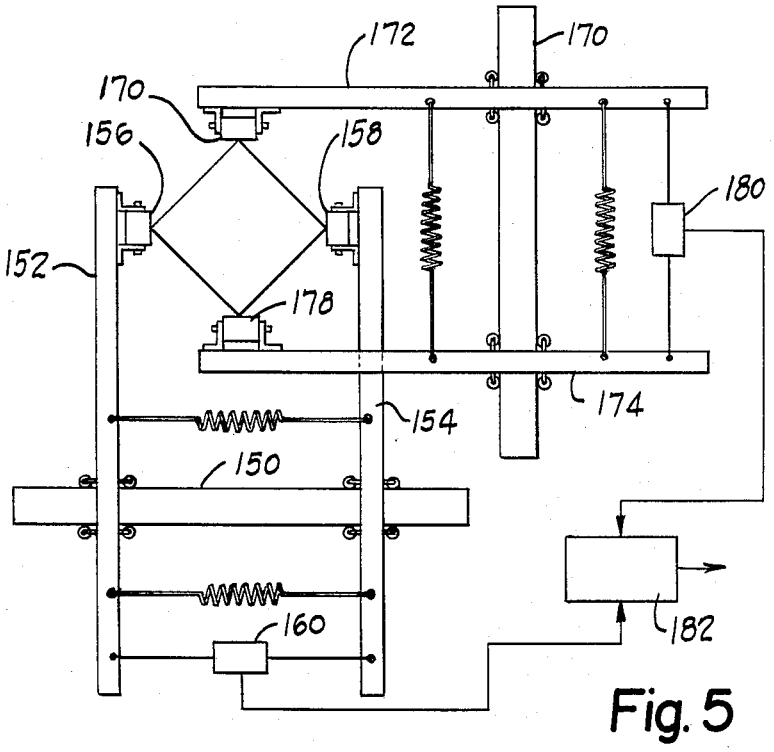
FIG. 5 is a top view of still another embodiment of the invention suitable for incorporation into the system of FIG. 1.

FIG. 5 illustrates another embodiment of the present invention. The embodiment of FIG. 5 illustrates apparatus and technique for simultaneously measuring both diagonals of a rectangular strand and for generating continuously a signal representing a sum or difference of the two measured diagonals.

There are two primary portions of the apparatus of FIG. 5, each similar to that illustrated in FIG. 4. More specifically, a support member 150, carrying guide arms 152, 154 and contact members 156, 158, measures one diagonal by way of an output of a detector 160.

Another portion of the apparatus comprises a support member 170 carrying guide arms 172, 174 and contact members 176, 178, for measuring the other diagonal as indicated by the output of another detector 180.

Optionally, the output from the detectors 160, 180 are fed to an albegraic summing circuit 182 which produces an output indicating continuously the sum or difference of the two diagonals. The use of the embodiment of FIG. 5 permits even more precise measurement and control of the dimensions of the strand than does the embodiment of either FIG. 3 or FIG. 4 taken alone. For example, the difference between the diagonals provides an enhanced, more sensitive indication of distortion, since this difference measurement is highly dependent on the defect.

This invention is applicable not only to casting, but to other metal processing operations whose function is to change the cross-sectional shape of the product, such as rolling operations. It is also not limited to steel, but can be used with other metals.

This invention is particularly useful in multistrand casting facilities, wherein several casters operate simultaneously. An embodiment of the shape monitoring apparatus can be applied to each strand, and the output signals from the several monitors can be observed at a central control station. If an undesirable shape change develops on a caster, the individual caster is shut down for remedial action, while the others continue in operation.

It is to be understood that the specific embodiments described in this document are illustrative, rather than exhaustive, of the invention. Those of ordinary skill in the relevant technical field will be able to make certain additions, deletions or modifications of these specific embodiments without departing from the spirit of the invention or its scope, as defined in the following appended claims.

We claim:

1. A method for continuously monitoring cross-sectional distortion in a relatively rigid hot cast metal product movable along a path and having ideally a predetermined rectangular cross-section, the product being subject during motion along the path to wavering movement transverse to the path, said method comprising the steps of:

(a) supporting first and second contact elements transversely displaced from said path for independent movement toward and away from said workpiece path and oriented to face inwardly toward diagonally opposed dihedral edges of a cast product moving along the path;

(b) biasing the contact elements against respective edges of the cast product, without appreciably thereby changing workpiece temperature, the edges being defined by dihedral angle intersections between exterior surfaces of the cast product, said biasing being of a force sufficient to facilitate continuous riding of the contact elements on the edges of the product while nonetheless limiting biasing force to a level sufficiently low to avoid any substantial alteration of the cross-sectional shape of the cast product due to impingement of the contact elements;

(c) producing by the use of a single transducer a single electrical signal representing the spacing between the contact elements for indicating distortion of the cross-sectional shape of the cast product independently of both absolute thickness dimension of the product, and of said wavering, and (d) indicating when said electrical signal deviates outside a predetermined range.

2. The method of claim 1, further comprising the steps of:

(a) supporting and biasing an additional pair of contact elements to oppositely impinge on the remainder of said edges defined by said rectangular cross-section of said cast product, and (b) producing a second electrical signal representing the diagonal distance between the edges impinged upon by the additional pair of contact elements.

3. The method of claim 1, further comprising the step of:

algebraically summing said electrical signals.

4. The method of claim 1, further comprising the step of:

separating on command the contact elements for disengaging the contact elements from the cast product.

5. The method of claim 1, further comprising the step of:

producing a tangible time record of said electrical signal.

6. The method of claim 1, further comprising the step of:

remedially modifying a characteristic of production of the cast product in response to said electrical signal.

7. A method for monitoring cross-sectional distortion in a relatively rigid cast product movable along the path and having ideally a predetermined rectangular cross-section, the product being subject during motion along the path to wavering movement transverse to the path, said method utilizing two contact elements and comprising the steps of:

(a) supporting the contact elements on different sides of the workpiece path independently movable toward and away from the workpiece moving along the path and oriented to face different edges of the workpiece;

(b) biasing the contact elements against opposed diagonal corners of the cast product, the edges being defined by intersections between exterior surfaces of the casting without said impingement substantially influencing workpiece temperature;

(c) said biasing step comprising applying a biasing force sufficient to facilitate continuous riding impingement of the contact elements on the edges of the product while limiting biasing force to a level sufficiently low to avoid any substantial deformation of the cross-sectional shape of the cast product due to impingement of the contact elements;

(d) producing an electrical signal representing the spacing between the contact elements, the electrical signal indicating distortion of the cross-sectional shape of the cast product independently of absolute thickness dimension of the product;

(e) producing an indication when the electrical signal deviates outside a predetermined range of values.

8. A method utilizing two contact elements for monitoring cross-sectional distortion in a relatively rigid cast product movable along a path and having ideally a predetermined rectangular cross-section, the product being subject during motion along the path to wavering movement transverse to the path, said method comprising the steps of:

(a) mounting each contact element facing diagonally opposed corners of the cast product as it moves along the path, said mounting rendering the contact elements independently movable toward and away from the workpiece path;

(b) applying a biasing force sufficient to facilitate continuous riding impingement of the contact elements on the cast product while avoiding substantial temperature change of the workpiece resultant on said impingement and limiting biasing force to a level sufficiently low to avoid any substantial alteration of the cross-sectional shape of the cast product due to impingement of the contact elements;

(c) facilitating, by means of said mounting and biasing steps, said contact elements to move transversely with respect to the workpiece path to track wavering motion of the cast product in response to said wavering motion;

(d) producing a single electrical signal representing the relative position of both contact elements, said electrical signal indicating distortion of said cross-sectional shape of said cast product, independently of said wavering, and (e) producing an indication when said electrical signal deviates outside a predetermined range.

9. A casting system comprising:

(a) a vertical mold adapted for accommodating molten metal for passage downwardly through the mold and casting it into a predetermined shape, said mold having a rectangular cross-sectional configuration defining the peripheral shape of the product to be cast, the location and orientation of said mold also defining a downwardly extending workpiece flow path along which the cast product passes subsequent to emergence from the mold, the cast product being subject during motion downwardly along the path, to wavering movement transverse to the path;

(b) support structure fixed to relative to the path;

(c) first and second guide arms movably mounted to said support structure, each arm extending on a different side of the path;

(d) first and second contact elements connected respectively to said first and second arms and oriented to face inwardly toward diagonally opposed dihedral edges of the cast product moving along the path said contact elements having a contact area which is small relative to the area of a side portion of the workpiece;

(e) means coupled to the guide arms for biasing the contact elements against said diagonally opposed edges of said cast product, said edges being defined by dihedral angle intersections between exterior surfaces of said cast product, said bias means applying a biasing force sufficient to facilitate continuous riding of the contact elements on said edges of the cast product while limiting biasing force to a level sufficiently low to avoid any substantial alteration of the cross-sectional shape of the cast product due to impingement of the contact elements, said bias means, guide arms and support structure cooperating to facilitate said contact elements to move independently transversely to said path to track wavering motion of the cast product in response to said wavering motion;

(f) a single transducer simultaneously coupled between said guide arms for producing an electrical signal representing the spacing between the contact elements, said electrical signal indicating distortion of said cross-sectional shape of said cast product independently of absolute thickness dimension of the product, and of said wavering motion and (g) means responsive to said electrical signal for indicating when said electrical signal deviates outside a predetermined range.

10. The system of claim 9, further comprising:

(a) an additional pair of contact elements;

(b) an additional pair of guide arms mounted on said support structure for orienting said additional contact elements to oppositely impinge on the remainder of said edges defined by said rectangular cross-section of said cast product;

(c) means for biasing said additional contact elements to oppositely impinge on said remainder of said edges, said (d) a second transducer coupler between said additional pair of guide arms for producing a second electrical signal representing the diagonal distance between the edges impinged upon by said additional pair of contact elements.

11. The system of claim 10, further comprising:

means connected to said transducers for algebraically summing said electrical signals.

12. The system of claim 9, further comprising:

power apparatus for separting on command the contact elements for disengaging contact elements from impingement upon the cast product.

13. The system of claim 9, further comprising:

feedback means responsive to said electrical signal for remedially modifying a characteristic of production of the cast product.

* * * * *

UNITED STATES PATENT AND TRADEMARK OFFICE

CERTIFICATE OF CORRECTION

PATENT NO. : 4,538,669

DATED : September 3, 1985

INVENTOR(S) : Kegham M. Markarian and Robert Sobolewski

It is certified that error appears in the above-identified patent and that said Letters Patent is hereby corrected as shown below:

Column 10, line 63, "said" should be --and--;

Column 10, line 64, "coupler" should be --coupled--.

Signed and Sealed this

*Nineteenth* Day of *November 1985*

[SEAL]

*Attest:*

DONALD J. QUIGG

*Attesting Officer*

*Commissioner of Patents and Trademarks*